United States Patent [19]

Gladow

[11] 4,037,501

[45] July 26, 1977

[54] THROUGH-THE-CYLINDER SLUG OUT DEVICE

[75] Inventor: Dean E. Gladow, Emporia, Kans.

[73] Assignee: Didde-Glaser, Inc., Emporia, Kans.

[21] Appl. No.: 698,115

[22] Filed: June 21, 1976

[51] Int. Cl.[2] ..... B26F 1/38

[52] U.S. Cl. ..... 83/100; 83/346

[58] Field of Search ..... 83/100, 346, 347, 300, 83/659, 165

[56] References Cited

U.S. PATENT DOCUMENTS

| | | | |
|---|---|---|---|
| 3,182,540 | 5/1965 | Eichorn | 83/346 |
| 3,209,630 | 10/1965 | McCartan | 83/100 |
| 3,482,478 | 12/1969 | Einhorn | 83/100 |
| 3,555,948 | 1/1971 | Olson | 83/346 X |

*Primary Examiner*—J. M. Meister

[57] ABSTRACT

A simplified, relatively low cost web-cutting cylinder and assembly adapted to be mounted on a web collator and having a vacuum-type, through-the-cylinder slug removal feature is provided which permits easy, clean, high-speed removal of successively cut web slugs produced when standard English-sized equipment is used to produce metric-sized business forms or the like. The cutting cylinder is adapted to be mounted adjacent a conventional, unmodified anvil cylinder and preferably includes an inwardly and axially extending, tapered bottom, slug-receiving slot or groove and a pair of slug-cutting peripheral knives mounted on opposite sides of the slot; a vacuum slug-removal system is coupled in communication with the slot for removing cut slugs without the necessity of any moving parts which can limit collator output and substantially increase equipment costs. Additionally, application of a vacuum pulling force on the slugs as they are cut significantly enhances high-speed slug removal and effectively solves the problem of incomplete cutting and hang-up of web fibers on the cutting blades.

20 Claims, 6 Drawing Figures

THROUGH-THE-CYLINDER SLUG OUT DEVICE

This invention relates to a web-cutting cylinder and assembly especially adapted for easy, high-speed removal of web slugs in order to clear such slugs from the cutting assembly as they are successively produced during rotation of the cutting cylinder. More particularly, it is concerned with such a cylinder and assembly which provides an excellent slug-removal capability notwithstanding the complete absence of moving parts such as stab pins or the like which can measurably decrease cutting speeds and increase equipment costs. In particular, the present invention contemplates the use of a vaccum system operatively coupled to the cutting assembly for conveying web slugs away from the assembly, in order to facilitate high-speed slug removal and overcome the common problems of incomplete web cutting and hang-up of web fibers in the cutting mechanism. In preferred forms, the cutting roll is slotted to define a slug-receiving slot or groove which is in communication with the vacuum-removal system, in order to ensure that successively cut slugs are removed and conveyed away from the cutting assembly in the quickest and most efficient manner.

In the production of multiple-page business forms, it is common to provide web collators which are capable of marrying a plurality of preprinted webs, gluing the webs along one marginal edge thereof, numbering and cutting the glued webs into forms of predetermined size, and finally collating and collecting the cut forms. Such collators are generally sized to produce business forms of certain standard dimensions corresponding to the printed increment length of standard length web printing plates; however, when such standard length plates are used to print non-standard or metric-sized images, excess unprinted portions within the increment length are inevitably produced. This is particularly significant when web presses constructed to produce standard English-measurement forms are used to produce metric-measurment forms. In particular, printing of metric-sized forms on such English-sized presses inevitably means that a certain amount of waste material will be produced when the forms are cut. This in turn leads to the serious problem of disposing of the waste web material or slugs produced by the web-cutting operation.

For example, a standard 17-in. web press is conventionally used to produce prined webs having 8½-in. images thereon. When such a 17-in. press is used to print, e.g., 21-cm. images, an excess of about ½-in. of web will be produced for each 17-in. increment. Thus, during subsequent cutting of the preprinted webs, it is necessary to cut and disposed of these unwanted web pieces or slugs.

In order to handle such excess slug material, it is conventional practice to provide a pair of spaced-apart cutting blades on the cutting cylinder which will cut a slug of the appropriate dimensions during each rotation of the cylinder. Although simple cutting of the slugs presents no real problems, removal thereof from the cutting mechanism can be extremely troublesome. As can be appreciated, unless the slugs are quickly and cleanly removed, they can foul the cuttig blades and necessitate slow-down of the collator. Thus, in order to employ a standard English-size collator in the production of metric-sized forms, it is necessary to overcome the problems inherent in the removal of waste slugs.

one possibility for removing web slugs involves provision of radially shiftable stab pins adjacent the periphery of the cutting cylinder between the slug-cutting blades, along with mechanism for successively extending and retracting the pins. The pins are adapted to be sequentially extended in order to "stab" the slugs as they are cut, whereupon the slugs can be removed from the pins. This concept necessarily requires mechanism for reciprocating the stab pins, and pin-receiving apertures in the adjacent anvil cylinder. In addition, the anvil cylinder must be in exact synchronization with the cutting cylinder and means such as a vacuum system must also be provided for removing the slugs from the stab pins during each revolution of the cutting cylinder.

A number of objections can be raised regarding mechanical slug removal apparatus of the type described above. Specifically, the cost thereof may be prohibitive in view of the necessity of providing radially shiftable pins and means for reciprocating the latter on a timed sequence. Furthermore, a number of specialized machining operations on both the cutting and anvil cylinders would be required, and this would further increase equipment costs. The necessity of exact synchronization between the cutting and anvil cylinders could also pose serious problems, along with the difficulty which could be encountered if the stab pins became bent or broken. Finally, it is possible that slug-removal apparatus of the stab pin variety would limit collator speed. Specifically, since the cutting cylinder is rotating at a relatively high rate of speed, centrifugal force is exerted upon the pin-held slugs and could tend to push the slugs off the pins prior to the scheduled removal thereof; accordingly, rotational speed of the cutting cylinder, and thereby the output of the entire collator, may have to be reduced.

It is therefore the most important object of the present invention to provide a simplified web-cutting assembly equipped for clean, high-speed cutting and removal of slugs of web material through the use of a slotted cylinder in the apparatus, along with vacuum slug-removal conduit apparatus in communication with the cylinder slot or opening serving to ensure clean, essentially complete cutting and through-the-cylinder removal of the slugs without fiber hang-up or the like notwithstanding elimination in the slug-removing apparatus of all moving parts and complicated mechanisms such as reciprocal stab pins or the like.

Another object of the invention is to provide an elongated, axially rotatable cutting cylinder having a pair of spaced, outwardly beveled, slug-cutting knives mounted on the periphery thereof, in conjunction with an adjacent axially rotatable anvil cylinder; one of the cylinders is configured to present an opening therein which is adapted for slug-receiving alignment with the spaced cutting knives during cutting of the slugs. The cutting assembly also includes slug-conveying structure including conduit means and apparatus such as a negative pressure-inducing blower for conveying the cut slugs from the cylinder opening. In preferred forms, the cutting cylinder is configured to present the slug-receiving opening between the spaced knives, since this eliminates the need to synchronize the cutting and anvil cylinders and moreover permits the use of essentially any size of standard anvil cylinder.

A still further object of the invention is to provide a rotatable web-cutting cylinder which is aapted to be mounted adjacent an anvil surface such as that presented by an anvil cylinder and which includes a pair of spaced, web-cutting knives mounted on the cylinder periphery and inclined toward each other, in conjunction with an inwardly and axially extending slug-receiving slot between the knife elements. In preferred forms, the bottom-defining wall of the slot is tapered towards one end of the cutting roll, and upraised molding structure is positioned along the slot bottom wall for preventing full contact between the cut web slugs and slot bottom wall which can impede the necessary vacuum-induced slug flow from the cylinder and through the slug-conveying conduit system.

Figure 1:
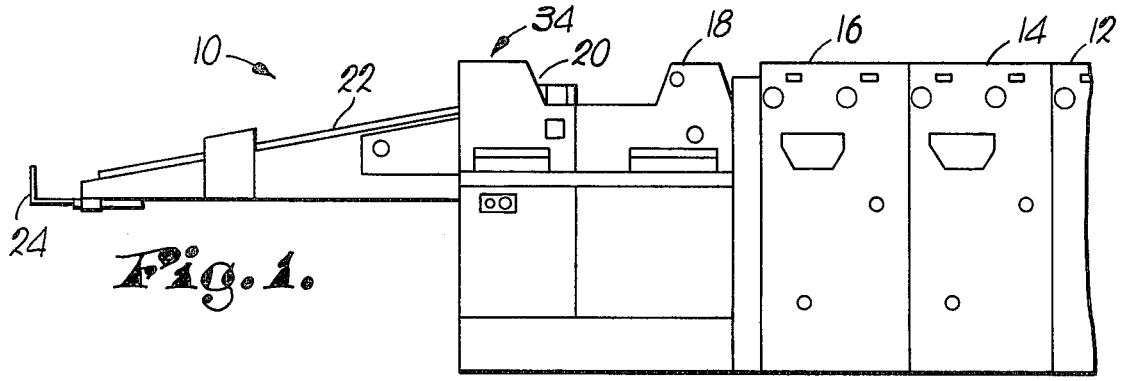
FIG. 1 is a fragmentary side elevational view of an in-line, multiple-station web collating apparatus used in the production of business forms and having the web-cutting asembly of the present invention mounted thereon.
Figure 2:
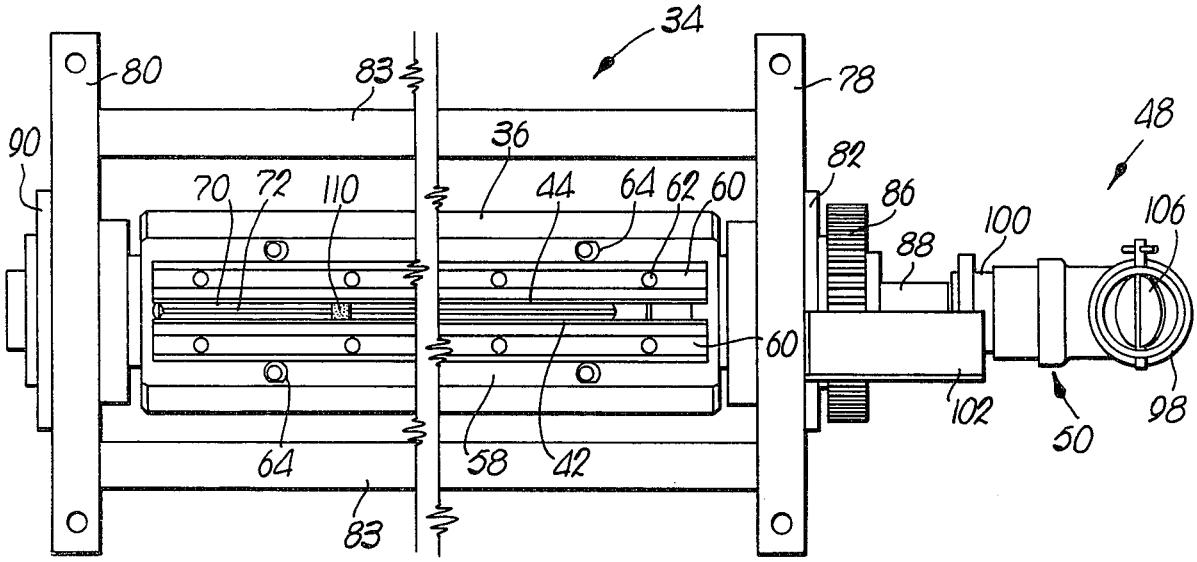
FIG. 2 is a fragmentary plan view of the web-cutting assembly of the invention.

Referring first to FIG. 1, an in-line, multiple-station collating apparatus 10 is illustrated which includes a number of separate web-handling stations such as marrying and gluing stations 12, 14, and 16, numbering and counting station 18, and cutting station 20. In addition, a delivery conveyor 22 is provided for receiving the output of cut business forms or the like from station 20, and collecting the latter in collection structure 24. As briefly explained above, collating apparatus 10 is operable to marry, glue, number and cut a plurality of preprinted webs and form, at high speeds, multiple-page business forms or similar items. Such collators are constructed to produce forms of various sizes from preprinted webs. For example, a common collator size is referred to as a "17-in." unit. With this collator it is possible to produce standard 8½-in. width forms from webs printed in 17-in. increments. Other more or less conventional sized collators based upon English measurements include 11- and 22-in. units.

Figure 6:
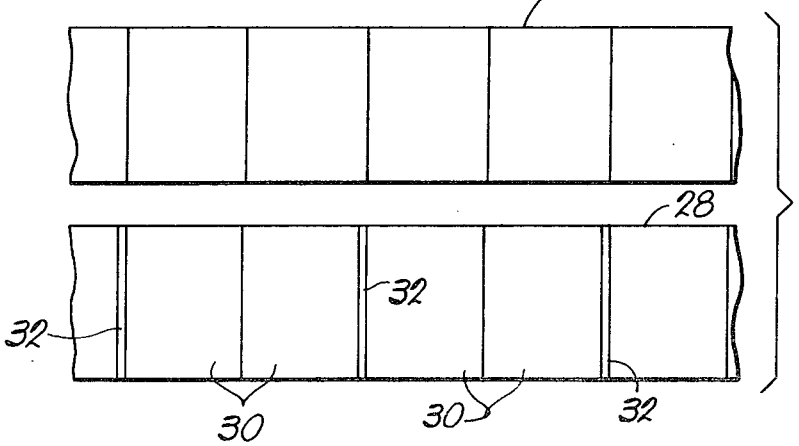
FIG. 6 is a plan view of a pair of web sections, with the upper section being marked for standard 8½-in. width forms, and the lower web section being marked for 21-cm. width forms.

When it is desired to employ a standard 17-in. web press to print metric-sized images, problems arise by virtue of the fact that the 17-in. printing increment is fixed. As explained above, a 17-in. press used in producing 21-cm. images will produce about ½-in. waste slug for every 17-in. printing increment. Referring specifically to FIG. 6, it will be seen that a web section 26 is marked as it would be printed for the production of 8½-in. width business forms. On the other hand, web section 28 is marked as it would be printed for the production of 21-cm. width business forms using the same press. Note in this respect that each pair of adjacent forms 30 is bounded by a narrow slug 32 of material which arises by virtue of the necessity of using fixed increment printing plates.

In order to produce a cut pattern complementary with the illustrated increments on web section 28, the cutting cylinder of the collator would necessarily include a pair of closely adjacent blades along with a single blade spaced approximately 180° fromthe blade pair. In any event, it will be seen that during production of 21-cm. business forms from web section 30, a significant amount of waste or slug material is generated, and in order to ensure smooth, high-speed operations, it is necessary that measures be taken to quickly and cleanly remove the waste material from the cutting assembly.

Turning now to the remaining Figures, a cutting assembly 34 in accordance with the invention broadly includes elongated, adjacent, aligned, axially rotatable cutting and anvil cylindrs 36 and 38 which cooperatively present a web-receiving and cutting nip area 40 therebetween, in conjunction with a pair of relatively closely spaced, elongated, rule-type cutting elements or knives 42 and 44 which are mounted on cylinder 36 adjacent an inwardly and axially extending, slug-receiving slot or groove 46 provided in cutting cyliner 36. Slug-conveying structure broadly referred to by the numeral 48 is also provided and includes conduit means 50 in communication with slot 46, and means, such as a conventional blower 52, for creating a negative pressure within opening 46 and conduit means 50 for conveying cut slugs away from apparatus 34 for ultimate disposal thereof.

In more detail, cutting cylinder 36 is of elngated, generally cylindrical configuration and includes a plurality of conventional, inwardly-extending, circumferentially-spaced, knife-receiving recesses 54 about the periphery thereof. Roll 36 can thus be equipped with the requisite number of cutting knives for forming business forms of a desired width. For example, in FIG. 3 a cutting knife 56 is illustrated in operative disposition within a recess 54. In this position, knife 56, along with closely spaced knives 42 and 44, would produce the cut pattern depicted in FIG. 6 (web section 28), in order to yield 21 -cm. width forms. In addition, cylinder 36 can be used for the production of both English- and metric-sized forms. Use of knives within the recesses 54*a* would yield 8½-in. forms, and in this case no slug-cutting knives would be provided.

Cylinder 36 is also configured to present a milled, generally planar surface 58 along the length thereof which is adapted for mounting of the slug-cutting blades 42 and 33 closely adjacent to slot 46. In this connection, conventional, elongated knife-mounting elements 60 secured in place by bolts 62 are preferably used for securing the blades 42 and 44 in place. Shiftable eccentrics 64 are preferably provided for permitting precise adjustment of the mounting elements 60 so that the adjacent blades can be set with accuracy. In this regard, it will be seen that the blades 42 and 44 are outwardly beveled away from slot 46, and moreover are mounted in an inclined fashion (94° with respect to surface 58) towards each other in order to facilitate passage of slugs into slot 46.

Slug-receiving slot 46 is preferably in the form of a radially inwardly and axially extending slot or groove defined by respective sidewalls 66 and bottom wall 68. The latter is preferably tapered along the length thereof so that slot 46 is deeper at the right-hand end thereof as viewed in FIG. 5. In addition, an elongated metallic molding 70 is disposed along the length of bottom wall 68 and includes an upstanding central ridge section 72. Molding 70 prevents slugs entering slot 46 from coming into full contact with bottom wall 68, as this has been found to impede slug flow in certain instances.

Cylinder 36 also includes an elongated, integral, tubular conduit section 74 which is in communication with slot 46 adjacent the deep end thereof. Section 74 is rotatable with cylinder 36 and defines the rotational axis of the latter, as will be explained.

Anvil cylinder 38 is positioned in adjacent, aligned, underlying relationship with cutting cylinder 36 and is in the form of a cylinder having a hardened anvil periphery 76. It is important to note in this connection that there is no necessity of providing cylinder 38 with specialized openings or the like, and accordingly, production of cylinder 38 is facilitated at relatively low cost.

Figure 5:
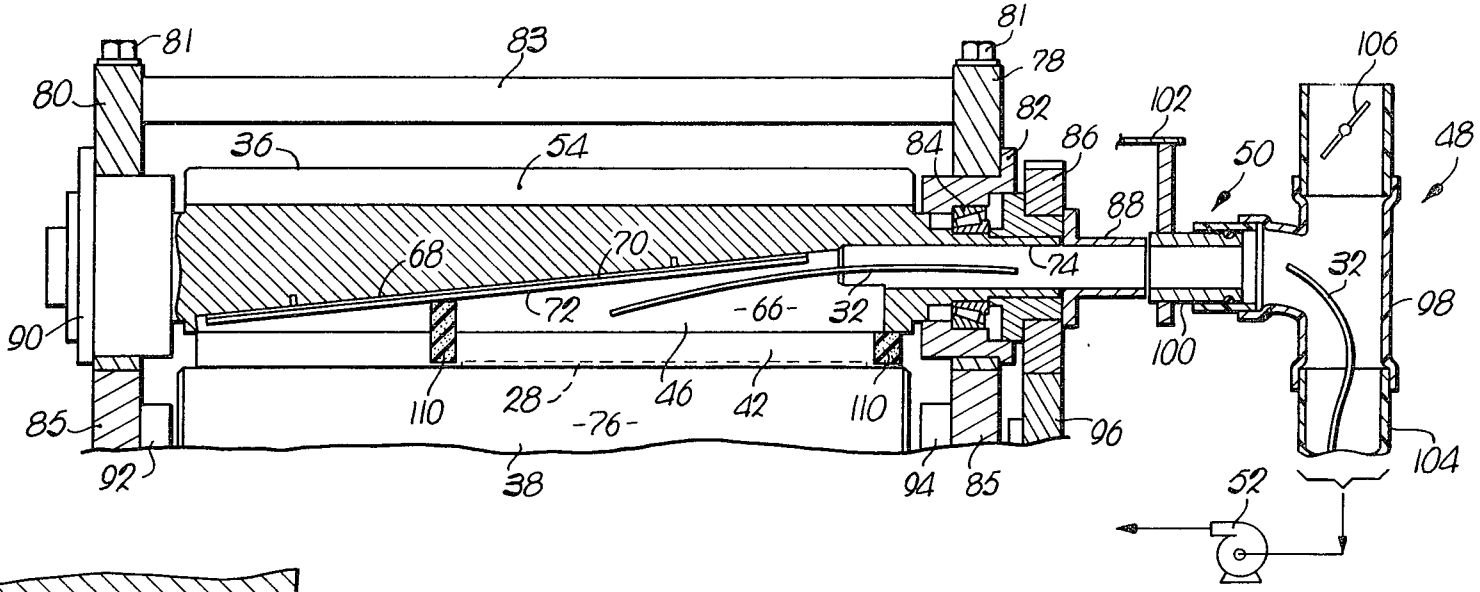
FIG. 5 is a fragmentary view in partial vertical section of the cutting assembly and illustrating the operation thereof in removing web slugs for disposal.

Mounting structure for cylinder 36 includes a pair of upstanding sidewalls 78 and 80 which support cylinder 36 as a removable unit or head. Referring to FIG. 5, it will be seen that sidewall 80 also supports an annular bushing 82 along with an annular bearing 84. Tubular section 74 of cylinder 36 is rotatably positioned within bearing 84 and has a gear 86 journaled to the outermost end thereof. Finally, a flanged tubular extension 88 is secured to the outer face of gear 86 for rotation therewith. The remaining end of cylinder 36 is supported by conventional bearing structure 90 provided in sidewall 80. Cylinder 36 and the related apparatus supported by sidewalls 78 and 80 can be removed from collator 10 simply by loosening the bolts 81 and lifting the entire head unit off the collator. It will be seen that the main sidewalls 85 of station 20 are appropriately recessed to receive the head unit. Moreover, rigidity of the cutting cylinder head is assured through the use of a plurality of cross-braces 83 extending between sidewalls 78 and 80.

Anvil roll 38 is rotatably supported by the main walls 85 of collator station 20. Separate bearing assemblies 92 and 94 are provided in the walls 85 for rotatably supporting the respective ends of cylinder 38, and the latter is equipped with a drive gear 96 exteriorly of the right-hand sidewall 85 as viewed in FIG. 5 which mates with gear 86. The mated gears 86 and 96 are driven by means (not shown) for simultaneous rotation of the cylinders 36 and 38 in opposite directions.

Slug-conveying structure 48 includes, in conjunction with section 74 and extension 88, a second conduit section 98 which leads away from apparatus 30 and which is in turn operatively connected to negative pressure-inducing blower 52. In more detail, conduit section 98 includes a tubular, generally horizontal connection portion 100 supported by bracket means 102, along with a main conduit section 104 leading away from apparatus 34. A manually shiftable damper 106 is preferably positioned within section 104 above portion 100 for precision control of the negative pressure condition within the slug-conveying structure 48.

When it is desired to convert a standard English-sized collator for the production of metric forms, it is only necessary to remove the existing cutting cylinder head unit by loosening the mounting bolts 81, whereupon the entire cutting cylinder head can be removed bodily from the collator. At this point a cutting cylinder head in accordance with the present invention is mounted over the anvil cylinder (which remains unmodified) by placing the sidewalls 78 and 80 into the complementary recesses in the sidewalls 85, whereupon the mounting bolts 81 are tightened. It will be noted in this respect that provision of external drive gear 86 with cutting cylinder 36 permits the latter to be operatively mounted and bolted into place without difficulty adjacent to anvil roll 38. The slug-conveying conduit system described above is then mounted into place adjacent extension 88, whereupon the collator can be used for the production of metric-sized forms.

Figure 3:
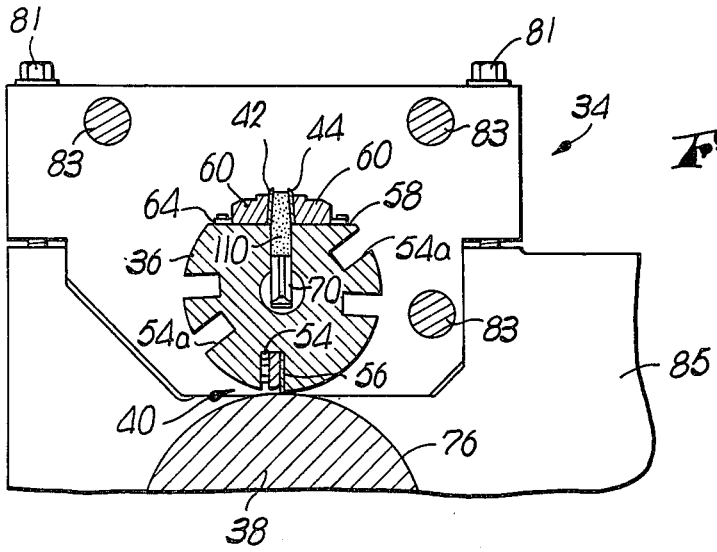
FIG. 3 is a vertical sectional view of the web-cutting assembly and illustrating the relative disposition of the slotted cutting cylinder and adjacent, underlying anvil cylinder.
Figure 4:
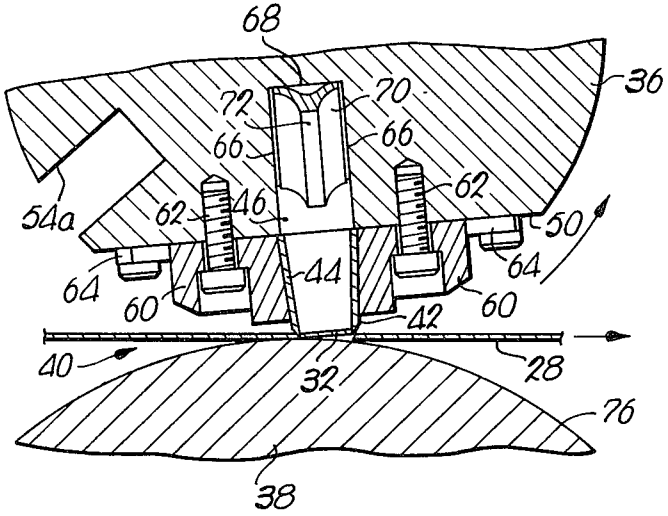
FIG. 4 is an enlarged, fragmentary vertical sectional view illustrating the cutting of a web slug during rotation of the cutting and anvil cylinders.

In this regard, webs fed through the collating apparatus and into the nip area 40 presented between cylinders 36 and 38 are successively cut into segments corresponding to the position of the knives mounted on the periphery of roll 36. For example, in the case of 21-cm. forms, the knife arrangement of FIG. 3 would be employed, and the FIG. 3 illustration depicts the position of the cutting cylinder during pinch-cutting of a line 108 between a pair of forms 30 (see FIG. 6). Continued rotation of the cylinders 36 and 38 causes production of a slug 32. This is illustrated in FIG. 4 wherein the closely adjacent knives 42 and 44 are shown during cutting of the web to produce a slug.

Turning now to FIG. 5, the slug-removal function of apparatus 34 will be explained. First, the negative pressure within slot 46 creates a pulling force on the slugs 32 as they are cut. This ensures that the slugs are cleanly cut from web 28; in fact, it has been determined that an incomplete cut of as much as ¼-in. can be pulled cleanly by providing the proper negative pressure within slot 46. In any event, as the slugs 32 are cut, they move into slot 46 and ultimately through tubular section 74, extension 88, connecting portion 100, and conduit section 98 for ultimate disposal. Unimpeded travel of the slugs is assured by virtue of the inward inclination of the blades 42 and 44, as well as the outward bevel thereof. Moreover, molding 70 provided along the bottom wall 68 of slot 46 ensures that the slugs to not come into full contact with the bottom wall 68. Thus, apparatus 34 provides essentially impedence-free travel of the slugs so that high-speed running of the collator is possible.

In certain instances it is preferred to provide a pair of resilient plugs 110 within slot 46 for closing off a portion of the slot and effectively increasing the negative pressure within the slug-conveying system. For example, in the case illustrated in FIG. 5 wherein the web 28 is of lesser width than the cylinders 36 and 38, the plugs 110 can be mounted a slight distance beyond the respective edges of web 28. Of course, plugs 110 are shiftable within slot 46 and can be mounted at essentially any point along the length thereof for the purpose described.

It will also be apparent that a number of modifications can be made in the particular apparatus described. For example, the slug-receiving slot could be provided in anvil roll 38 without departing from the spirit and scope of the present invention. It is only necessary in this respect that the slot or opening be adapted for slug-receiving alignment with the knives 42 and 44 during slut-cutting operations so that the slugs can be received. In the preferred apparatus described above, the slot 46 is of course in registry with the space between inclined knives 42 and 44; however, if a slug-receiving slot were provided in anvil roll 38, it would be necessary to synchronize the rotation of the respective cylinders for ensuring proper registration between the cutting knives and slot during the slug-cutting sequence. Furthermore, use of an anvil roll having a slug-receiving slot therein could present machining problems and thereby increase equipment costs. Accordingly, the apparatus described above is preferred.

As another example, both rolls of the cutting head assembly could be provided with slug-receiving openings and slug-cutting knives, with the respective cylinder openings being coupled to a vacuum-slug-removal system. In this case the knife pairs of the respective cylinders would be out of synchronization in order to cut separate slugs without interference between the knife pairs, and each cylinder would present an anvil surface for the knives in the adjacent cylinder.

It will also be apparent that the cutting apparatus described can be used in a wide variety of web-handling machines other than collators; therefore, it should be understood that the description above in connection with an in-line web collator represents only one possible environment of use, and that the invention hereof is not limited to collators.

Having thus described the invention, what is claimed as new and desired to be secured by Letters Patent is:

1. A web-cutting assembly equipped for through-the-cylinder slug removal, said assembly comprising:

an elongated, axially rotatable cutting cylinder;

an elongated, axially rotatable anvil cylinder adjacent said cutting cylinder, said cutting and anvil cylinders cooperatively presenting a web-receiving and cutting nip area therebetween;

at least a pair of spaced cutting elements mounted on the periphery of said cutting roll and operable for successively cutting slugs from a web passing through said nip area as the cutting and anvil cylinders rotate, at least one of said cylinders including structure defining an elongated, axially and inwardly extending slot therein which is adapted for slug-receiving alignment with said pair of elements during cutting of said slugs for receiving the latter, said slot-defining structure including spaced, opposed sidewall portions and a bottom wall portion which is tapered inwardly from a point adjacent one end of the roll to the opposite end thereof;

slug-conveying structure including means located adjacent said opposite end of said one roll and proximal to the axis of the latter and in communication with said slot for conveying cut slugs from the slot; and structure rotatably supporting said cutting and anvil cylinders in web-receiving and cutting disposition.

2. The assembly as set forth in claim 1 wherein said cutting cylinder is configured to present said slot.

3. The assembly as set forth in claim 2 wherein said cutting elements are mounted adjacent the respective defining sidewalls of said slot.

4. The assembly as set forth in claim 1 including at least one additional web-cutting element mounted on the periphery of said cutting roll in spaced relationship to said pair of elements.

5. The assembly as set forth in claim 1 wherein said slug-conveying means includes conduit means having a tubular conduit section mounted on said opposite end of said one cylinder in communication with said slot and defining the axis of rotation of the one cylinder, a second conduit section coupled to said first section and leading away from said assembly, and a negative pressure-inducing blower operatively connected to said conduit sections.

6. The assembly as set forth in claim 1 including means positioned within said slot for preventing flow-impeding contact between the bottom wall defining the slot and said slugs.

7. The assembly as set forth in claim 1 including shiftable resilient plus positioned in said slot to define a slug-receiving space therein which is slightly longer than the width of the slugs.

8. A rotatable web-cutting roll adapted to be mounted adjacent an anvil surface and comprising:

an elongated, generally cylindrical, axially rotatable roll including structure defining an inwardly and axially extending, slug-receiving slot therein, said slot-defining structure including spaced, opposed sidewall portions and a bottom wall portion which is tapered inwardly from a point adjacent one end of the roll to the opposite end thereof;

means located adjacent said opposite end of the roll and proximal to the axis of the latter and in communication with said slot for conveying cut slugs from the slot; and at least a pair of web-cutting elements mounted on the periphery of said roll on opposite sides of said slot and operable for cooperatively cutting slugs from a web passing between said anvil surface and the roll as the latter rotates.

9. The cutting roll as set forth in claim 8 including means positioned within said opening for preventing flow-impeding contact between said bottom wall portion and said slugs.

10. The cutting roll as set forth in claim 9 wherein said contact-preventing means comprises molding structure disposedon said bottom wall portion.

11. The cutting roll as set forth in claim 8 wherein said slug-conveying means comprises tubular structure extending axially from said opposite end of said roll for passage of said slugs therethrough.

12. The cutting roll as set forth in claim 11 wherein said tubular structure is disposed a long the rotational axis of said roll.

13. The cutting roll as set forth in claim 8 wherein said pair of elements are inclined toward each other for facilitating passage of said slugs into said slot.

14. The cutting roll as set forth in claim 8 including at least one additional web-cutting element mounted on said roll in spaced relationship to said pair of elements.

15. The cutting roll as set forth in claim 8 wherein said elements are mounted closely adjacent to the defining sidewalls of said slot.

16. The cutting roll as set forth in claim 8 wherein the cutting edges of said blades are beveled outwardly relative to said slot.

17. A web-cutting assembly equipped for through-the-cylinder slug removal, said assembly comprising:

an elongated, axially rotatable cutting cylinder;

an elongated, axially rotatable anvil cylinder adjacent said cutting cylinder said cutting and anvil cylinders cooperatively presenting a web-receiving and cutting nip area therebetween;

at least a pair of spaced cutting elements mounted on the periphery of said cutting roll and operable for successively cutting slugs from a web passing through said nip area as the cutting and anvil cylinders rotate, at least one of said cylinders being configured to present an opening therein which is adapted for slug-receiving alignment with said pair of elements during cutting of said slugs for receiving the latter;

means positioned within said opening for preventing flow-impeding contact between the bottom wall of said opening and said slugs;

slug-conveying structure including means for creating a negative pressure within said opening for conveying said slugs from said opening and away from said assembly; and structure rotatably supporting said cutting and anvil cylinders in web-receiving and cutting disposition.

18. A web-cutting assembly equipped for through-the-cylinder slug removal, said assembly comprising:

an elongated, axially rotatable cutting cylinder;

an elongated, axially rotatable anvil cylinder adjacent said cutting cylinder, said cutting and anvil cylinders cooperatively presenting a web-receiving and cutting nip area therebetween;

at least a pair of spaced cutting elements mounted on the periphery of said cutting roll and operable for successively cutting slugs from a web passing through said nip area as the cutting and anvil cylinders rotate, at least one of said cylinders being configured to present an opening therein which is adapted for slug-receiving alignment with said pair of elements during cutting of said slugs for receiving the latter;

shiftable resilient plugs positioned in said opening to define a slug-receiving space which is slightly longer than said slugs;

slug-conveying structure including means for creating a negative pressure within said opening for conveying said slugs from said opening and away from said assembly; and structure rotatably supporting said cutting and anvil cylinders in web-receiving and cutting disposition.

19. A rotatable web-cutting roll adapted to be mounted adjacent on anvil surface and comprising:

an elongated, generally cylindrical, axially rotatable roll configured to present an inwardly extending, slug-receiving opening therein;

at least a pair of web-cutting elements mounted on the periphery of said roll on opposite sides of said opening and operable for cooperatively cutting slugs from a web passing between said anvil surface and the roll as the latter rotates; and means positioned within said opening for preventing flow-impeding contact between the bottom wall defining said opening and said slugs.

20. A rotatable web-cutting roll adapted to be mounted adjacent an anvil surface and comprising:

an elongated, generally cylindrical, axially rotatable roll configured to present an inwardly extending, slug-receiving opening therein;

at least a pair of web-cutting elements mounted on the periphery of said roll on opposite sides of said opening and operable for cooperatively cutting slugs from a web passing between said anvil surface and the roll as the latter rotates; and shiftable resilient plugs positioned in said opening to define a slug-receiving space therein longer than said slugs.

* * * * *